US005219024A

United States Patent [19]

Potier

[11] Patent Number: 5,219,024

[45] Date of Patent: Jun. 15, 1993

[54] HEAT EXCHANGER HAVING A BUNDLE OF TUBES, IN PARTICULAR FOR A MOTOR VEHICLE

[75] Inventor: Michel Potier, Rambouillet, France

[73] Assignee: Valeo Thermique Moteur, Le-Mesnil-Saint Denis, France

[21] Appl. No.: 852,536

[22] Filed: Mar. 17, 1992

[30] Foreign Application Priority Data

Mar. 20, 1991 [FR] France ..... 91 03412

[51] Int. Cl.[5] ..... F28F 9/02

[52] U.S. Cl. ..... 165/173; 165/151; 165/175

[58] Field of Search ..... 165/173, 175, 177

[56] References Cited

U.S. PATENT DOCUMENTS 3,897,821 8/1975 Babunovic et al. .
4,546,824 10/1985 Melnyk .
4,593,755 6/1986 Rogers, Jr. ..... 165/145
4,893,672 1/1990 Bader ..... 165/163
4,967,836 11/1990 Nakamura ..... 165/173

FOREIGN PATENT DOCUMENTS 622510 6/1927 France ..... 165/173
63-169499 7/1988 Japan ..... 165/173
580678 9/1946 United Kingdom .
1018143 1/1966 United Kingdom ..... 165/173

*Primary Examiner*—Allen J. Flanigan
*Attorney, Agent, or Firm*—Morgan & Finnegan

[57] ABSTRACT

A heat exchanger of the kind comprising a bundle of tubes arranged in at least one range of tubes, with each tube having a body terminating in an end portion which is received in a collecting plate. At least two adjacent tubes of the bundle define a terminal pitch distance separating their respective end portions, this pitch distance being different from a central pitch distance between their respective bodies.

10 Claims, 2 Drawing Sheets

HEAT EXCHANGER HAVING A BUNDLE OF TUBES, IN PARTICULAR FOR A MOTOR VEHICLE

FIELD OF THE INVENTION

This invention relates to a heat exchanger of the kind comprising a bundle of tubes arranged in at least one range i.e., row of tubes, with each tube comprising a body terminating in an end portion which is received in a collecting plate of the heat exchanger. This collecting plate (which is also referred to as a perforated plate), is part of a water box or manifold of the heat exchanger which is mounted at one end of the tube bundle, with the other end of the tube bundle commonly, but not necessarily, having a similar water box or manifold.

BACKGROUND OF THE INVENTION

Such heat exchangers most usually find application in motor vehicles having internal combustion engines, and are used either as engine coolant radiators or as radiators in the heating system for the cabin of the vehicle. A coolant fluid, most commonly a mixture of water and glycol, flows through the tubes of the heat exchanger in a closed circuit, and is cooled by heat transfer with air passing through the heat exchanger and around the tubes.

The tubes conventionally have a circular transverse cross section, both in the body of each tube and in its end portions. However, with a view to optimising the heat transfer performance of this type of heat exchanger, and in particular with a view to reducing mechanical losses in the cooling air passing through the heat exchanger, it is also common practice to use tubes in which the body of the tube is of a non-circular transverse cross section, this being usually oblong, i.e. of a shape which generally defines a major axis and a minor axis. Such oblong tubes may be of the "flat", oval, or elliptical type. In such non-circular tubes, the end portion usually has a transverse cross section having a different shape from the cross section of the tube body. It will typically be less oblong than the body and may indeed be circular, to avoid any possible deformation of the end portion. In other words, in the end portion, the difference in length between the major and minor axes is less than that in the body of the tube, and may even be zero.

The end portions are open into a water box or manifold, with the collecting plate forming an inner wall of the water box. In order to separate the interior of the water box from the space in which air flows around the tubes, it is necessary to seal the end portions of the tubes in the collecting plate. Such sealing is often obtained in practice by means of an appropriate sealing gasket which is compressed between the end of the tube and a lip formed on the collecting plate and surrounding the corresponding hole in the latter through which the end portion of the tub extends. With this arrangement, the pressure exerted by the sealing gasket gives rise to a danger that the end portion of the tube may be squeezed towards a flattened shape.

Regardless of the cross sectional tube shape and type of collecting plate adopted, it is necessary that the amount of material in the collecting plate between two adjacent holes in the latter should be as small as possible consistent with the required mechanical strength of the plate. In other words, the pitch distance between adjacent holes in the plate should be minimised. The extent to which this can be done is of course limited by the need to form and accommodate the lips with which the holes in the connecting plate are normally bounded.

Under these conditions it is difficult to optimise the pitch distances between the various tubes, having regard to the different criteria which must be satisfied to produce a satisfactory heat exchanger design, and in particular to produce a satisfactory collecting plate.

DISCUSSION OF THE INVENTION

A main object of the invention is to overcome the drawbacks mentioned above. In particular, an object of the invention is to improve the thermal performance of heat exchangers of this type and to make them more versatile.

According to the invention, there is provided a heat exchanger comprising a bundle of tubes arranged in at least one range, with each tube having a body terminating in an end portion which is received in a collecting plate, characterised in that at least two adjacent said tubes of the tube bundle define a terminal pitch distance separating their respective end portions, with the said terminal pitch distance being different from a central pitch distance separating their respective bodies.

Due to the fact that the terminal and central pitch distances are of different values (whereas hitherto they have been of the same value), the heat exchanger is able to be made in a number of different embodiments to suit particular applications, i.e. the versatility of the heat exchanger and the scope for suitable customised design is increased, while the heat exchanger performance is also improved.

In a first form of the invention, the terminal pitch distance of two adjacent tubes is greater than the central pitch distance between the same tubes. The tubes defining these pitch distances, adjacent to each other, are then preferably in two different ranges of tubes in the bundle.

Thus, for a given pitch distance between two adjacent holes in the collecting plate, being part of two different series of holes in the plate and corresponding therefore to the terminal pitch distance defined above, the pitch distance between the bodies of the tubes is able to be reduced, which consequently enables the overall width of the tube bundle to be reduced.

In this type of embodiment of the invention, the respective end portions of the two said adjacent tubes of the tube bundle are each received individually in a respective hole formed in the collecting plate, with the latter having a plurality of series of such holes which are arranged in such a way that the pitch distance separating two adjacent holes in two different ranges of tubes corresponds to the terminal pitch distance of the tubes.

However, in another type of embodiment of the invention, the terminal pitch distance between two adjacent tubes is smaller than the central pitch distance between the same tubes, and the size of the collecting plate can then be reduced, in particular as regards its width.

In a further type of embodiment of heat exchanger according to the invention, the two adjacent tubes defining the above mentioned pitch distances are part of two different ranges of tubes in the bundle, which enables the width of the collecting plate to be reduced; preferably, the tubes in the said bundle are grouped in pairs of adjacent tubes, and in that the respective end portions of the two adjacent tubes in each pair are received in a common hole formed in the collecting plate, the number of said holes in the collecting plate being the same as the number of pairs of tubes.

In other heat exchangers according to the invention, the two adjacent tubes defining a terminal pitch distance and a central pitch distance are part of the same range of tubes. Here again, and preferably, the tubes in the said bundle are grouped in pairs of adjacent tubes, and in that the respective end portions of the two adjacent tubes in each pair being received in a common hole formed in the collecting plate, the number of said holes in the collecting plate being the same as the number of pairs of tubes. This type of embodiment of the invention is of particular interest because it enables the length of the collecting plate to be reduced.

Preferably, in the various types of embodiment of the invention mentioned above, the bodies of the tubes of the tube bundle have a generally oblong transverse cross section, while their end portions have a less oblong transverse cross section, which may be circular.

The invention is of course applicable also to heat exchangers in which the cross section of the tubes is in fact circular, both in their body and their end portions. Whatever the type of embodiment of the invention adopted, the tubes are able to be assembled to the collecting plate (or collecting plates if there is one at each end of the tube bundle) using conventional fitting and assembly techniques, for example through a sealing gasket or by brazing, adhesion, and so on.

Preferred embodiments of the invention will be described below, by way of example only and with reference to the accompanying drawings.

DESCRIPTION OF PREFERRED EMBODIMENTS OF THE INVENTION

Figure 1:
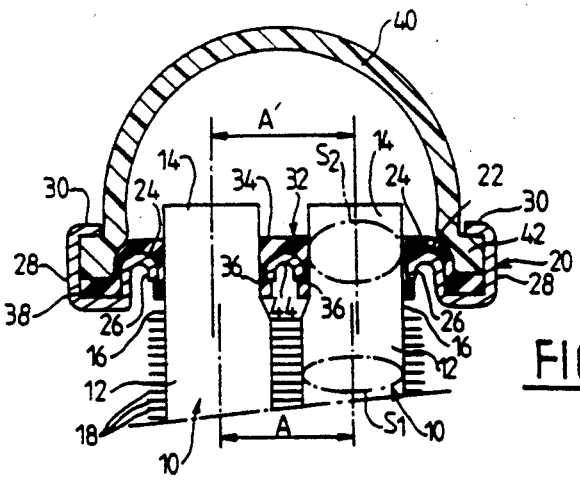
FIG. 1 is a view in transverse cross section of part of a heat exchanger in a first embodiment of the invention.

Reference is first made to FIG. 1, which shows a heat exchanger comprising a bundle consisting of a multiplicity of tubes 10 arranged in two ranges. In FIG. 1, two adjacent tubes are shown, each of which is part of a respective one of these two ranges.

Each tube 10 has a body 12 with a transverse cross section S1 which is not circular and which, in this example, is substantially elliptical. The body 12 is terminated in an end portion 14 which has been deformed so as to have a transverse cross section S2 which is non-circular in shape and which in this example is substantially elliptical. The cross section S2 is of a less elongated elliptical shape than the cross section S1, so that the major axis of the ellipse in the cross section S2 is shorter than the major axis of the ellipse in the cross section S1, while the minor axis in the cross section S2 is longer than the minor axis in the cross section S1.

The body 12 and end portion 14 of each tube 10 have a common generator 16 which is oriented towards the outside of the bundle. The respective tube bodies 12 of two adjacent tubes 10, in two different ranges of the bundle, are therefore separated from each other according to a central pitch distance A, while their respective end portions 14 are separated from each other according to a terminal pitch distance A' which is greater than A.

The tube bundle of the heat exchanger also includes a multiplicity of cooling fins 18 which extend parallel to each other and each of which has two sets of holes to accommodate the tube bodies 12 of the tubes 10. The end portions 14 are received in a collecting plate 20 which, in this example, consists of a metal plate comprising a spine portion 22, of generally rectangular shape, in which two series of holes 24 are formed. Each hole 24 has a transverse cross section of a shape matching that of the end portion of the corresponding tube 10. Each hole 24 is surrounded by a lip 26 which is bent downwards towards the fins 18.

The spine portion 22 is surrounded over its entire perimeter by a bent-up flange 28 which defines a groove and which terminates in tabs 30 which are arranged to be bent over. Sealing between the end portions 14 of the tubes 10 and the holes 24 of the collecting plate 20 is obtained by means of a sealing gasket 32. The latter comprises a spine portion 34, the shape of which is generally rectangular, matching the shape of the spine portion 22 of the collecting plate 20. The spine portion 34 has two series of holes, each of which is edged with a compressible gasket lip 36, which is arranged to be compressed between a hole 24 of the collecting plate and the end portion 14 of the tube 10 which is received in the corresponding hole. The spine portion 34 of the sealing gasket 32 is also provided around its entire perimeter with a compressible bead 38 which fits in the peripheral groove defined by the flange 28 of the collecting plate 20.

The heat exchanger also includes a water box or manifold wall 40, which has a generally rectangular open side defined by a peripheral water box flange 42, which is arranged to be introduced into the groove of the collecting plate defined in the collecting plate flange 28, in such a way as to compress the gasket bead 38 when the tabs 30 are bent over the water box flange as shown in FIG. 1.

In the embodiment shown in FIG. 1, the collecting plate 20 includes an integral bridge portion 44 between two adjacent holes 24 of two different series corresponding to the two ranges of tubes 10. For reasons of mechanical strength in the collecting plate, and in order that the collecting plate lips 24 can be formed, the integral bridge portion 44 cannot be smaller than a certain minimum size. As a result, the pitch distance between the holes 24 in the collecting plate, which corresponds to the terminal pitch distance A' described above, must itself be no smaller than a certain minimum size. Accordingly, for a given pitch distance A' of minimum value, it is possible to make the tube bundle such that the central pitch distance A is smaller than the terminal pitch distance A'. This enables the dimensions of the tube bundle of the heat exchanger to be optimised for given dimensions of the collecting plate or tube bundle.

At the other end of the tube bundle (not shown), the tubes 10 may have further end portions which are formed in a similar way to the end portions 14, so as to receive a collecting plate similar to the collecting plate 20, and be associated in the same way with a further water box wall. In a modification, however, the tubes 10 may be joined together in pairs by U-shaped tube sections so as to eliminate the need for a second water box at the other end.

Figure 2:
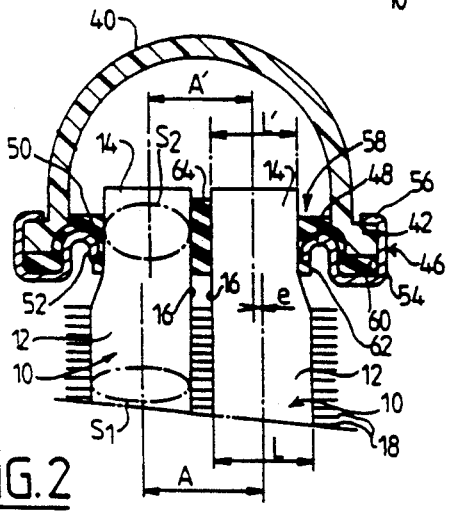
FIG. 2 is a view in transverse cross section of part of a heat exchanger in a second embodiment of the invention.

Reference is now made to FIG. 2, which shows a further heat exchanger which, as in the heat exchanger shown in FIG. 1, has two ranges of tubes 10, with each tube having a tube body 12 of transverse cross section S1 and an end portion 14 of transverse cross section S2. Again as in FIG. 1, each of the tubes 10 in FIG. 2 defines a generator 16 which is common to its body 12 and end portion 14. However, in this particular case, the generators 16 of two adjacent tubes are disposed on the inner side of the tube bundle, that is to say adjacent to each other.

The heat exchanger seen in FIG. 2 includes a collecting plate 46 having a spine portion 48 of generally rectangular shape and defining a single range of holes 50. The transverse cross section of each hole 50 is oblong, the hole being adapted to receive at the same time the respective end portions 14 of two adjacent tubes 10 in two respective ranges of the tube bundle. Each of the holes 50 is edged with a collecting plate lip 52 which projects downwards towards the cooling fins 18. The spine portion 48 of the collecting plate 46 again has a bent-up flange (indicated in FIG. 2 by the reference numeral 54), extending over its entire periphery and terminating in tabs, 56, which are arranged to be bent over as shown in FIG. 2.

A sealing gasket 58, of generally rectangular shape and having a peripheral bead 60, is applied over the spine portion 48 of the collecting plate 46, so that the bead 60 is received in the groove of the collecting plate 46 defined by its flange 54. The sealing gasket 58 is formed with two series of holes for receiving the end portions 14 of the tubes 10 in the two ranges of tubes of the bundle. These holes are arranged in pairs, with each pair of holes being surrounded by a gasket lip 62 substantially in the form of a figure of eight and adapted for mating engagement in a respective one of the collecting plate lips 52, so as to provide a seal between the latter and the two associated tube end portions 14. The gasket lip 16 is traversed centrally by an integral bridge portion 64 in the intermediate region between two adjacent tubes held in the pair of holes.

The bridge portion 64, which forms part of the gasket 58, is narrower than the integral bridge portion 44 of the collecting plate 20 in the heat exchanger described above with reference to FIG. 1. Having regard to the small width of the bridge portion 64, and the fact that the terminal pitch distance A' is smaller than the central pitch distance A, it will be realised that with the arrangement shown in FIG. 2 the water box is able to be narrower than the water box of FIG. 1.

If the width of the tube body 12, measured along the major axis of its elliptical cross section S1 is L, and if the largest dimension of the end portion 14 of the tube, that is to say the dimension measured along the major axis of the elliptical cross section S2, is L', and if the difference between the pitch distances A and A' is e, then:

$$L'/2+e=L/2.$$

Figure 3:
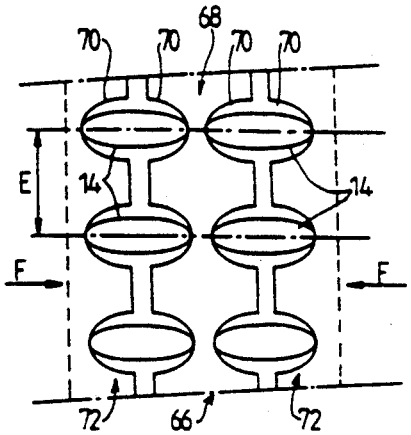
FIG. 3 is a diagrammatic top plan view of a press tool for forming the ends of the tubes in the heat exchanger shown in FIG. 2.

Reference is now invited to FIG. 3, which shows a press tool 66 for reforming the end portions of the tubes of the tube bundle. The tool 66 includes a fixed central jaw element 68 which includes on two opposed sides a series of half apertures 70, the shape of each of which corresponds to a half of an ellipse of the cross section S2. The press tool 66 also has two moving jaw elements 72, each having a set of half apertures 70 similar to those of the central jaw element 68. The half aperture 70 of the central jaw element 68 and moving jaw element 72 are separated in pairs by a pitch distance E which corresponds to the pitch distance between the tubes of a single range of the tube bundle.

The end portions 14 of the tubes 10 have, before being reformed, a transverse cross section S1 identical to that of the tube body 12. The end portions are reformed simultaneously, so as to give them their final cross section S2, by moving the two lateral or moving jaw elements 72 towards each other on either side of the central jaw element 66, as indicated by the arrows F.

Figure 4:
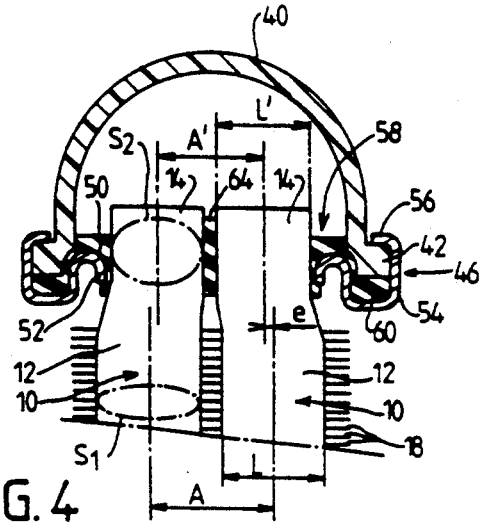
FIG. 4 is a view in transverse cross section of part of a heat exchanger similar to that shown in FIG. 2.

Reference will now be made to FIG. 4, which shows a modified form of the embodiment of heat exchanger already described with reference to FIG. 2. In FIG. 4, those elements which are common to those of FIG. 2 are indicated by the same reference numerals. The arrangement of FIG. 4 differs from that of FIG. 2 in that each of the tubes 10 does not define a generator common to both its body 12 and end portion 14. Accordingly:

$$L'/2+e>L/2.$$

Figure 5:
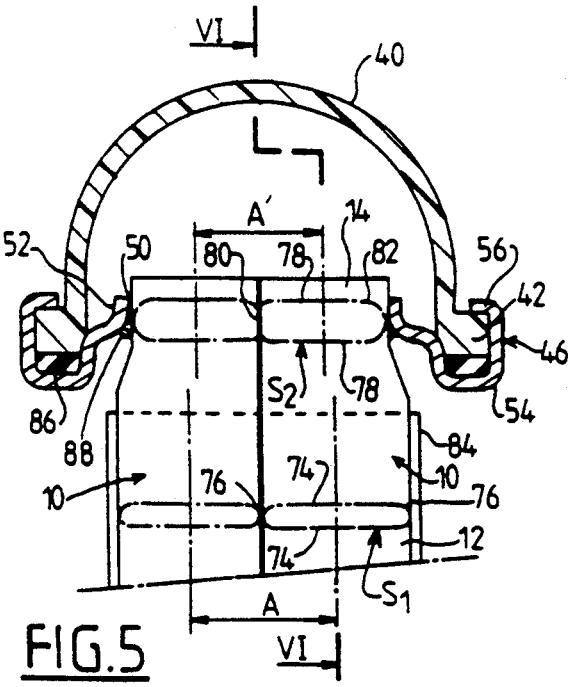
FIG. 5 is a view in transverse cross section of part of a heat exchanger in a further embodiment of the invention.
Figure 6:
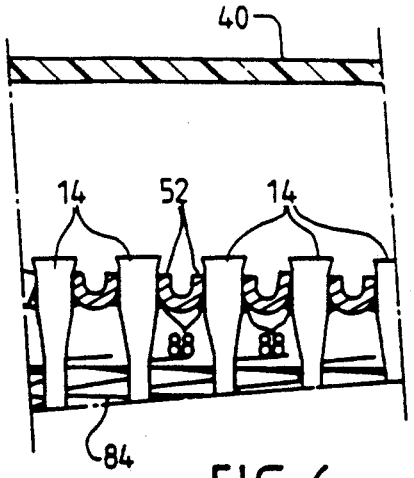
FIG. 6 is a partial elevation seen in cross section taken on the line VI—VI in FIG. 5.

Referring now to FIGS. 5 and 6, the third embodiment of heat exchanger according to the invention shown therein comprises two ranges of tubes 10, each of which consists of a body 12 having a transverse cross section S1 which is not circular, and which in this example is defined by two parallel portions 74 and two semi-circular portions 76 so as to give a tube of the "flat" type. The body 12 of each tube is extended in a reformed end portion 14 having a non-circular transverse cross section S2 which, in this example, is defined by two parallel portions 78, a flat inner portion 80, and a semi-circular outer portion 82. The length of the cross section S2 is smaller than that of the cross section S1, but its width is greater as shown in FIG. 5. The tubes 10 are again grouped in pairs, in such a way that the respective end portions 14 of one pair of tubes are received in a common hole 50 of a collecting plate 56 similar to that in FIGS. 2 and 4. However, in the present embodiment, the hole 50 is edged with a collecting plate lip 52 which projects upwardly towards the water box wall 40. As in the arrangement described with reference to FIGS. 2 and 4, the collecting plate 46 is bounded by a bent-up flange 54 having tabs 56 which can be bent over as shown in FIG. 5 so as to receive the water box flange 42. However, in the arrangement of FIGS. 5 and 6, there is merely a simple sealing gasket 86. The latter lies in the base of the groove of the collecting plate defined behind the flange 54 of the latter.

In the embodiment shown in FIGS. 5 and 6, the tubes 10 are plated with a relatively low melting point alloy such that each pair of end portions 14 can readily be brazed into a corresponding hole 50, so as to form a brazed joint 88. The intermediate or spacing elements 84 are also brazed between the adjacent tubes of each pair. It should also be noted that in this embodiment, the terminal pitch distance A' is smaller than the central pitch distance A. However, this arrangement enables the width of the water box to be reduced still further, due to the fact that the two tubes of a given pair of tubes are in contact over their entire length.

Figure 7:
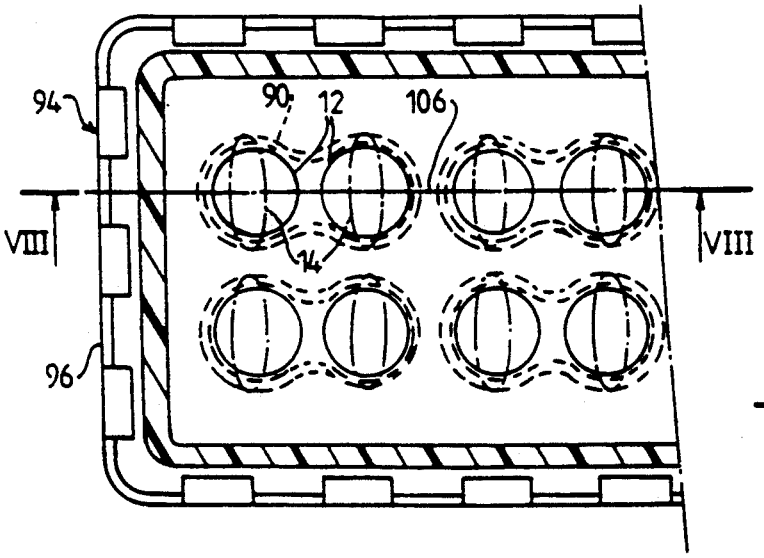
FIG. 7 is a plan view seen in cross section on the line VII—VII in FIG. 8, showing part of a further heat exchanger in accordance with the invention.
Figure 8:
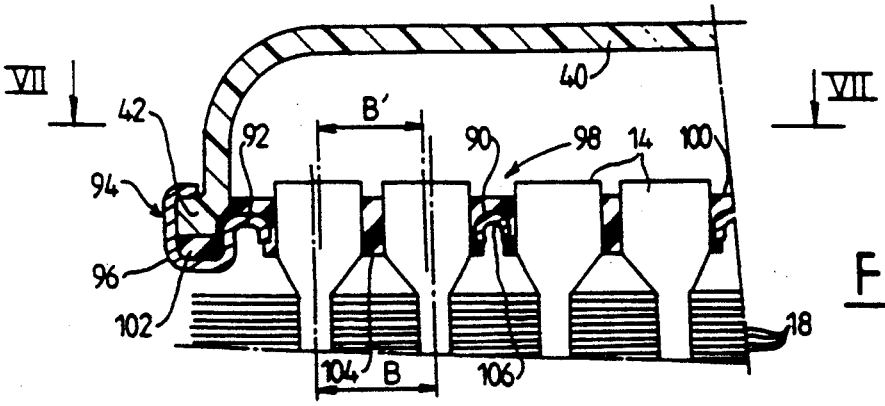
FIG. 8 is a view in cross section taken on the line VIII—VIII in FIG. 7.

Reference will now be made to FIGS. 7 and 8, which show a fourth embodiment of heat exchanger having two ranges of tubes 10. In this embodiment, the tubes are grouped in pairs within each range of tubes. Thus in this example, the body 12 of each tube has a transverse cross section which is non-circular, being in this case substantially elliptical, whereas the end portion 14 of each tube has a circular transverse cross section. The two end portions 14 of any one pair of these tubes are received in a common hole 90 which is of elongated shape. A series of these holes 90 is formed through the rectangular spine portion 92 of the collecting plate 94, which has a bent-up flange 96 extending around its periphery. Each hole 90 is in the form of two intersecting circles, as is best seen in Figure 7.

A sealing gasket 98 overlies the spine portion 92 of the collecting plate, and itself comprises a spine portion 100 of generally rectangular shape adapted to fit on the collecting plate spine portion 92. The gasket spine portion 100 is again edged by a peripheral bead 102 which fits in the peripheral groove defined in the collecting plate behind the flange 96 of the latter, so as to form, with the peripheral bead 42 of the water box wall 40, a peripheral seal. The spine portion 100 of the sealing gasket is formed with circular holes corresponding to the cross sectional shape of the end portions 14 of the associated tubes 10. These holes formed through the sealing gasket are grouped in pairs, with each pair being surrounded by a gasket lip 104 which is generally in the form of a figure of eight. Each gasket lip 104 is thus introduced into a hole 90 of the collecting plate, so as to grip the two end portions 14 of the tubes in a given pair of tubes. Thus, in any one pair of tubes 10, the terminal pitch distance B' between the end portions 14 of the tubes is smaller than the central pitch distance B between the bodies of the tubes. This enables the end portions of the tubes to be made circular while reducing the dimensions of the water box, since the collecting plate has integral bridge portions 106 between the pairs of tubes in a range of the latter, and not between the tubes of one range and those of another as in the embodiments previously described.

Figure 9:
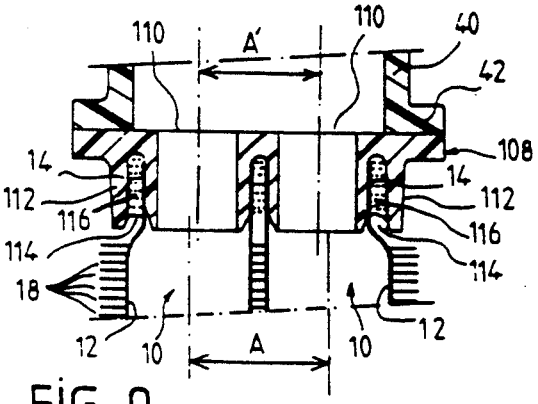
FIG. 9 is a view in cross section showing part of a heat exchanger in yet another embodiment of the invention.

In the fifth embodiment of the heat exchanger shown in FIG. 9, to which reference is now made, the tubes 10 again, as in the arrangement described above with reference to FIG. 2, define a pitch distance A' which is smaller than the pitch distance A. In addition, each tube 10 defines a generator 16 common to the body 12 and end portion 14 of the tube, this generator being on the inner side of the tube bundle. In the FIG. 9 arrangement, the heat exchanger includes a collecting plate 108 of plastics material, in which are formed holes 110 each of which is surrounded by a collecting plate lip 112 projecting towards the cooling fins 18 of the tube bundle. Each of the collecting plate lips 112 is formed with an annular groove 114, the shape of which is matched to that of the end portion 14 of the associated tube 10, with the latter being lodged within this groove. The end portion of the tube is secured adhesively in the corresponding groove 114 by means of an appropriate adhesive 116, which may for example be of the type comprising two component parts mixed together. The peripheral bead 42 of the water box wall 40, which in this case is also of a plastics material, is adhesively secured on the periphery of the collecting plate 108.

It will be understood that, although in the embodiments described above the heat exchanger has non-circular tubes, the invention is also applicable to heat exchangers having tubes of circular cross section.

What is claimed is:

1. A heat exchanger comprising a collecting plate formed with through holes, and a bundle of tubes disposed in at least one row, with each said tube comprising a body defining a central axis and terminating in an end portion defining an end portion central axis, said central axes of the body and end portions being substantially parallel, each end portion being received in a said hole through the collecting plate, wherein at least two adjacent tubes of the bundle have central axes of their bodies and end portions which are substantially coplanar and define a terminal pitch distance between the central axes of their respective end portions and a central pitch distance separating the central axes of their respective bodies, the terminal pitch distance being different from the central pitch distance.

2. A heat exchanger according to claim 1, wherein said terminal pitch distance is greater than said central pitch distance.

3. A heat exchanger according to claim 2, wherein said at least two adjacent tubes defining said pitch distances are in separate rows of the tube bundle.

4. A heat exchanger according to claim 2, wherein said holes through the collecting plate are arranged in a plurality of series of holes, arranged so as to define between two adjacent holes in two different said series of holes a pitch distance corresponding to said terminal pitch distance of the tubes, with the respective end portions of two tubes of the bundle defining said terminal pitch distance being received each in a separate one of said holes.

5. A heat exchanger according to claim 1, wherein the terminal pitch distance is smaller than the central pitch distance.

6. A heat exchanger according to claim 5, wherein said at least two adjacent tubes defining said pitch distances are in separate rows of the tube bundle.

7. A heat exchanger according to claim 6, wherein the tubes are grouped in pairs of adjacent tubes, the number of said holes in the collecting plate being the same as the number of pairs of tubes, with the end portions of the tubes in each pair being received in the same said hold.

8. A heat exchanger according to claim 5, wherein the two adjacent tubes defining said terminal pitch distance and central pitch distance are in the same row of tubes in the tube bundle.

9. A heat exchanger according to claim 8, wherein the tubes are grouped in pairs of adjacent tubes, the number of said holes in the collecting plate being the same as the number of pairs of tubes, with the end portions of the tubes in each pair being received in the same said hole.

10. A heat exchanger according to claim 1, wherein the body of each tube has a generally oblong transverse cross section having a major axis and a minor axis, with the end portion of each tube defining a transverse cross section having a length defining a major axis and a width defining a minor axis in which the difference in length between the major axis and the minor axis of the transverse cross section of the end portion is in the inclusive range of zero to a value less than that of the corresponding difference between the lengths of the major and minor axis of the transverse cross section of the body.

* * * * *